US011101068B2

(12) United States Patent
Kahn

(10) Patent No.: US 11,101,068 B2
(45) Date of Patent: Aug. 24, 2021

(54) INTEGRATED BARRIER FOR PROTECTING THE COIL OF AIR CORE REACTOR FROM PROJECTILE ATTACK

(71) Applicant: Trench Limited—Trench Group Canada, Toronto (CA)

(72) Inventor: Kamran Kahn, Ontario (CA)

(73) Assignee: TRENCH LIMITED—TRENCH GROUP CANADA, Toronto (CA)

( * ) Notice: Subject to any disclaimer, the term of this patent is extended or adjusted under 35 U.S.C. 154(b) by 809 days.

(21) Appl. No.: 15/494,890

(22) Filed: Apr. 24, 2017

(65) Prior Publication Data

US 2017/0316871 A1 Nov. 2, 2017

Related U.S. Application Data

(60) Provisional application No. 62/329,511, filed on Apr. 29, 2016.

(51) Int. Cl.

| | |
|---|---|
| ***H01F 27/06*** | (2006.01) |
| ***H01F 37/00*** | (2006.01) |
| ***F41H 5/04*** | (2006.01) |

(52) U.S. Cl.

CPC ..... *H01F 37/005* (2013.01); *F41H 5/04* (2013.01)

(58) Field of Classification Search

CPC ..... H01F 27/06; H01F 37/005; H01F 5/02; H01F 30/08

USPC ..... 336/65, 67, 82, 90

See application file for complete search history.

(56) References Cited

U.S. PATENT DOCUMENTS

| | | | | |
|---|---|---|---|---|
| 3,309,639 | A * | 3/1967 | Goolsby, Jr. | H01F 27/33 336/100 |
| 4,690,793 | A * | 9/1987 | Okamura | G21B 1/13 228/122.1 |
| 5,182,075 | A * | 1/1993 | Gotoh | G21B 1/13 376/136 |
| 5,196,627 | A * | 3/1993 | Owen | B01J 14/00 585/701 |
| 5,349,893 | A * | 9/1994 | Dunn | F41H 5/04 2/2.5 |
| 6,221,327 | B1 * | 4/2001 | DeCourcy | B01J 8/008 423/376 |
| 6,408,786 | B1 * | 6/2002 | Kennedy | C23C 16/4404 118/723 AN |

(Continued)

FOREIGN PATENT DOCUMENTS

| | | | |
|---|---|---|---|
| CN | 202090459 U | * | 12/2011 |
| CN | 204242728 U | * | 4/2015 |

*Primary Examiner* — Alexander Talpalatski
*Assistant Examiner* — Joselito S. Baisa

(57) ABSTRACT

An air core reactor for use in an electric power transmission and distribution system or in an electric power system of an electrical plant is provided. The air core reactor comprises an electrically insulated support structure, an outer surface of a coil of windings configured to operate at a potential and isolated to ground or other potentials by the electrically insulated support structure and a projectile resistant cylinder that attaches directly to the outer surface of the coil of windings. The projectile resistant cylinder is configured as an integrated barrier to provide a first measure of survivability to the air core reactor such that the integrated barrier enables a continued operation of equipment after a threat has been eliminated.

8 Claims, 3 Drawing Sheets

(56) References Cited

U.S. PATENT DOCUMENTS

| | | | | |
|---|---|---|---|---|
| 6,619,181 | B1 * | 9/2003 | Frey | F41H 5/007 428/911 |
| 7,055,733 | B2 * | 6/2006 | Weil | B23K 1/0008 228/122.1 |
| 7,656,648 | B2 * | 2/2010 | Cant | H02G 5/04 361/637 |
| 8,176,828 | B2 * | 5/2012 | Carberry | B32B 17/10036 89/36.02 |
| 8,327,462 | B2 * | 12/2012 | Feldman | F41H 5/0478 2/2.5 |
| 8,522,664 | B2 * | 9/2013 | Chen | F42D 5/045 89/36.02 |
| 8,544,240 | B2 * | 10/2013 | Hughes, Jr. | E04C 2/22 52/589.1 |
| 8,695,476 | B2 * | 4/2014 | Kucherov | F41H 5/0407 89/36.02 |
| 9,289,023 | B2 * | 3/2016 | Archbold | A42B 3/121 |
| 9,341,445 | B2 * | 5/2016 | de Haas | F41H 5/0485 |
| 2010/0330341 | A1 * | 12/2010 | Percival | B32B 17/04 428/172 |
| 2011/0100291 | A1 * | 5/2011 | D'Evelyn | C30B 7/105 117/11 |
| 2012/0174757 | A1 * | 7/2012 | Grace | F41H 5/04 89/36.02 |
| 2013/0273326 | A1 * | 10/2013 | Denifl | B32B 9/04 428/166 |
| 2015/0002254 | A1 * | 1/2015 | Beigel | B05D 3/007 336/221 |
| 2016/0104568 | A1 * | 4/2016 | Best | H01F 5/02 336/199 |
| 2016/0131457 | A1 * | 5/2016 | Bain | F41H 5/0492 89/36.02 |

* cited by examiner

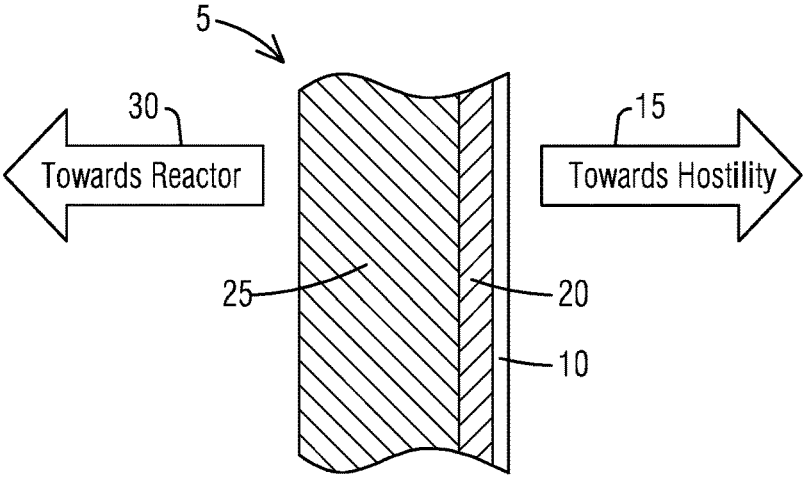
FIG. 1
FIG. 2
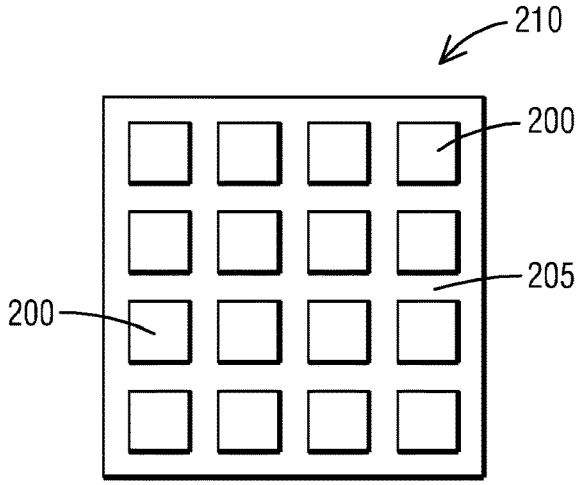
FIG. 5
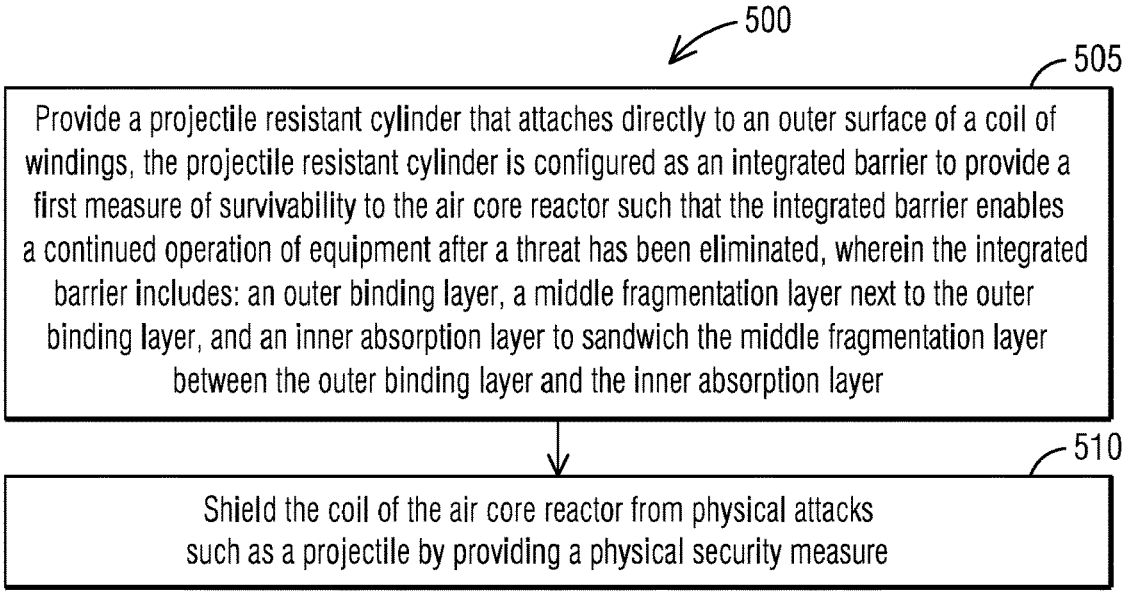

INTEGRATED BARRIER FOR PROTECTING THE COIL OF AIR CORE REACTOR FROM PROJECTILE ATTACK

CROSS REFERENCE TO RELATED APPLICATIONS

This application claims the benefit of U.S. Provisional Application Ser. No. 62/329,511 entitled "INTEGRATED PROJECTILE BARRIER FOR SUBSTATION EQUIPMENT," filed on Apr. 29, 2016, the contents of which are hereby incorporated by reference herein in their entirety.

BACKGROUND

1. Field

Aspects of the present invention generally relate to an integrated barrier for protecting a coil of an air core reactor from a projectile attack and more specifically relate to a projectile resistant cylinder that attaches directly to an outer surface of a coil of windings of an air core reactor to shield it from hostile attacks by providing physical security measures.

2. Description of the Related Art

The vulnerability of substations to terrorist attacks is a new phenomenon. Physical attacks on a Bulk-Power System could adversely impact the reliable operation of the Bulk-Power System, resulting in instability, or cascading failures. So entities ought to take steps to reasonably protect against physical security attacks on the Bulk-Power System.

The industry is currently struggling to assess and develop physical security strategies (most notably FERC Order No. 802/NERC CIP-014). The purpose of Reliability Standard CIP-014-1 is to enhance physical security measures for the most critical Bulk-Power System facilities and thereby lessen the overall vulnerability of the Bulk-Power System against physical attacks.

To date, efforts have been concentrated on the perimeter protection of a substation and the protective shielding of transformers via walls. The concept of shielding any other equipment is not known.

Therefore, to provide for a reliable operation there is a need to address threats and vulnerabilities to the physical security of critical facilities such as electrical power systems.

SUMMARY

Briefly described, aspects of the present invention relate to providing a measure of survivability to air core reactor's electrical systems from hostile attacks upon a substation by non-military organizations (e.g. terrorism). An integrated projectile barrier is configured to protect a coil of an air core reactor from a projectile attack. Integrated Projectile Barrier would be sacrificial in nature. Its sole purpose is to improve survivability during an incident and not to remain operating indefinitely with any damage incurred during hostility.

In accordance with one illustrative embodiment of the present invention, an air core reactor for use in an electric power transmission and distribution system or in an electric power system of an electrical plant is provided. The air core reactor comprises an electrically insulated support structure, an outer surface of a coil of windings configured to operate at a potential and isolated to ground or other potentials by the electrically insulated support structure and a projectile resistant cylinder that attaches directly to the outer surface of the coil of windings. The projectile resistant cylinder is configured as an integrated barrier to provide a first measure of survivability to the air core reactor such that the integrated barrier enables a continued operation of equipment after a threat has been eliminated.

In accordance with another illustrative embodiment of the present invention, an air core reactor for use in an electric power transmission and distribution system or in an electric power system of an electrical plant is provided. The air core reactor comprises a projectile resistant cylinder that attaches directly to an outer surface of a coil of windings. The projectile resistant cylinder is configured as an integrated barrier to provide a first measure of survivability to the air core reactor such that the integrated barrier enables a continued operation of equipment after a threat has been eliminated. The integrated barrier includes an outer binding layer, a middle fragmentation layer next to the outer binding layer and an inner absorption layer to sandwich the middle fragmentation layer between the outer binding layer and the inner absorption layer.

In accordance with another illustrative embodiment of the present invention, a method of shielding an air core reactor is provided. The method comprises providing a projectile resistant cylinder that attaches directly to an outer surface of a coil of windings. The projectile resistant cylinder is configured as an integrated barrier to provide a first measure of survivability to the air core reactor such that the integrated barrier enables a continued operation of equipment after a threat has been eliminated. The integrated barrier includes an outer binding layer, a middle fragmentation layer next to the outer binding layer and an inner absorption layer to sandwich the middle fragmentation layer between the outer binding layer and the inner absorption layer.

BRIEF DESCRIPTION OF THE DRAWINGS

FIG. 1 illustrates a cross sectional view of an integrated projectile barrier in accordance with an exemplary embodiment of the present invention.

FIG. 2 illustrates a schematic representation of a plurality of hard ceramic tiles encapsulated in a resin layer in accordance with an exemplary embodiment of the present invention.

FIG. 5 illustrates a flow chart of a method of shielding an air core reactor according to an exemplary embodiment of the present invention.

DETAILED DESCRIPTION

Figure 3:
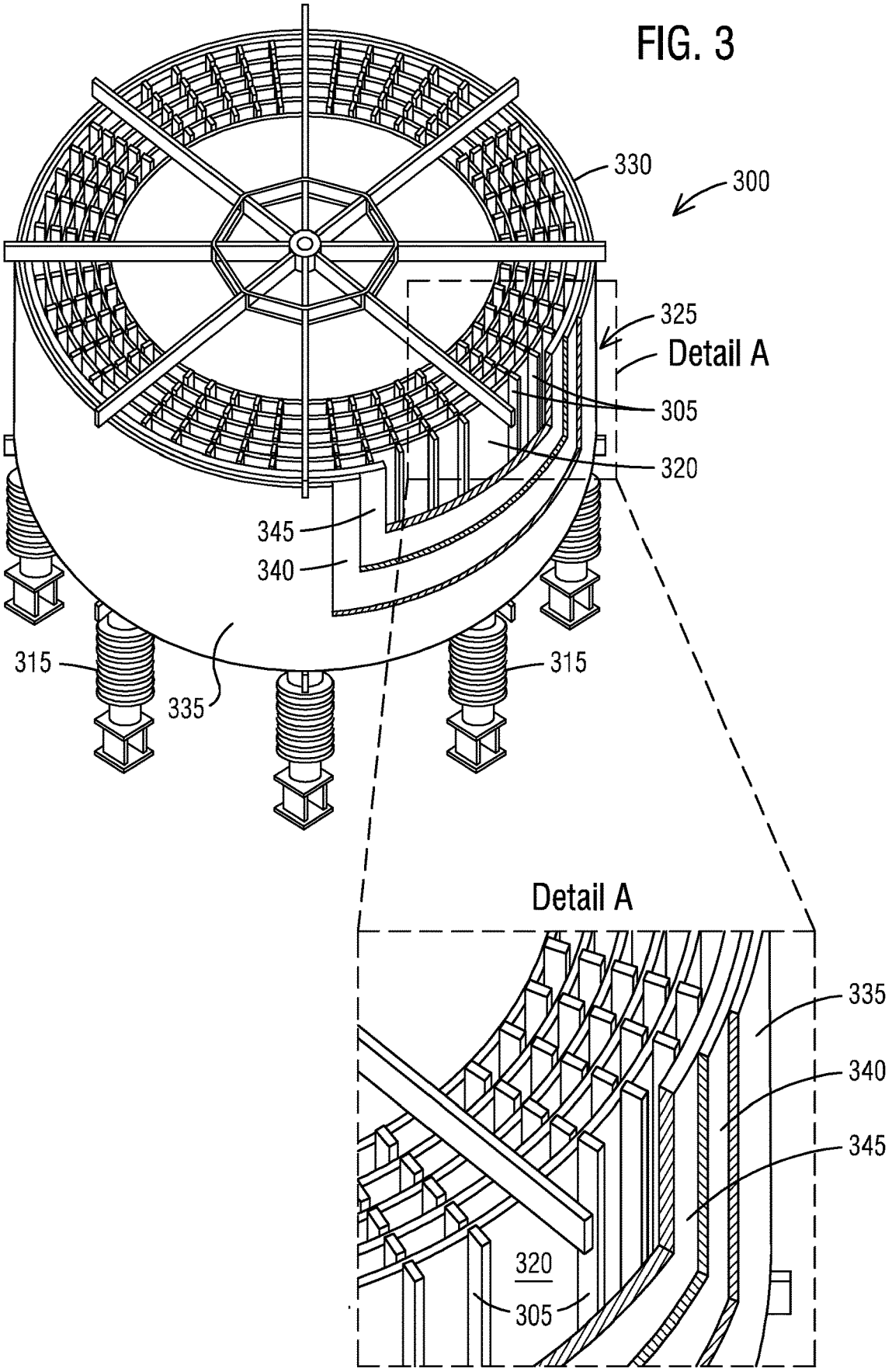
FIG. 3 illustrates a perspective view of an application of the integrated projectile barrier of FIG. 1 in an air core reactor with duct sticks in accordance with an exemplary embodiment of the present invention.

To facilitate an understanding of embodiments, principles, and features of the present invention, they are explained hereinafter with reference to implementation in illustrative embodiments. In particular, they are described in the context of a projectile resistant cylinder that attaches directly to an outer surface of a coil of windings of an air core reactor to shield it from hostile attacks by providing physical security measures. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Consistent with one embodiment of the present invention, FIG. 1 represents a cross sectional view of an integrated projectile barrier 5 in accordance with an exemplary embodiment of the present invention. The integrated projectile barrier 5 is used with an air core reactor (as shown in FIG. 2) that is for use in an electric power transmission and distribution system or in an electric power system of an electrical plant. The integrated projectile barrier 5 is configured to attach directly to a coil (not shown) of windings configured to operate at a potential and isolated to ground or other potentials by an electrically insulated support structure (not shown). The integrated projectile barrier 5 to provide a first measure of survivability to the air core reactor such that the integrated projectile barrier 5 enables a continued operation of equipment after a threat has been eliminated.

In a reactor application, the integrated projectile barrier 5 would be constructed with the air core reactor and spaced from the reactor's coil of windings via the spacers (typically called "duct sticks") in a conventional manner used to separate winding groups. In one embodiment, the integrated projectile barrier 5 includes three separate layers concentrically layered in a shape of a cylinder. For example, a projectile resistant cylinder attaches directly to an outer surface of coil of windings. This projectile resistant cylinder is configured as the integrated projectile barrier 5. The three layers include a thin external layer, a thicker middle layer and a thickest internal layer which all are designed to provide a unique functionality and a different type of protection measure or shielding from a physical attack on the air core reactor in a form of a ballistic projectile.

The integrated projectile barrier 5 includes an outer binding layer 10 on a towards hostility side 15, a middle fragmentation layer 20 next to the outer binding layer 10 and an inner absorption layer 25 on a towards reactor side 30. The inner absorption layer 25 is configured to sandwich the middle fragmentation layer 20 between the outer binding layer 10 and the inner absorption layer 25.

The outer binding layer 10 is configured to make the air core reactor appear nondescript from a typical air core reactor. The outer binding layer 10 comprises fiberglass roving and epoxy resin. The middle fragmentation layer 20 is configured to disperse energy of a projectile via fragmenting the projectile. The middle fragmentation layer 20 comprises a ceramic material. The inner absorption layer 25 is configured to decelerate fragments of a projectile and absorb any remaining energy. The inner absorption layer 25 comprises a combination of fiberglass roving, reinforced cloths and epoxy resin.

The integrated projectile barrier 5 may comprise of laminates made up of multiple layers. These barrier laminates provide protection against various threats based mainly on the thickness of the laminates. The integrated projectile barrier 5 may not be disadvantaged in that it won't have a significant weight for the size of the barrier. In addition, an effective integrated projectile barrier 5 does not have an excessive thickness. The integrated projectile barrier 5 has a reduced weight to area ratio and a reduced thickness to area ratio.

The techniques described herein can be particularly useful for using a multi-layer barrier. While particular embodiments are described in terms of a multi-layer, integrated projectile barrier the techniques described herein are not limited to these three layers but can also use other combination of layers or a single layer with multi-layer characteristics.

Referring to FIG. 2, it illustrates a schematic representation of a plurality of tiles 200 encapsulated in a layer 205 for an integrated projectile barrier 210 in accordance with an exemplary embodiment of the present invention. The integrated projectile barrier 210 may have a two-dimensional array of hardened tiles 200 that are encapsulated in the layer 205. The hardened tiles 200 may be ceramic tiles and a resin layer may be encapsulating these tiles. For example, the plurality of hardened tiles 200 may be arranged side-by-side in a two-dimensional array. The integrated projectile barrier 210 limits any damage due to a projectile hitting the barrier to the tile 200 hit by the projectile. This tiled design of the integrated projectile barrier 210 limits the progression of damage due to a projectile hit from being transferred to adjacent tiles 200. The materials of the plurality of hardened tiles 200 may be selected to not affect the electrical functioning of the coil. For example, ceramic for the middle fragmentation layer 20 is a suitable material, but not the only material possible.

Preferably, each of the tiles 200 has a flat, parallel, front and back surface. The tiles 200 are also formed with flat sidewalls that are arranged in a polygonal configuration. This enables the tiles 200 to be arranged in a two-dimensional array, where the spacing between adjacent tiles 200 is minimized. The plurality of tiles 200 may be arranged in a single two-dimensional layer with opposing sidewalls of adjacent tiles 200 being in close proximity to each other. The spacing between the opposing sidewalls of adjacent tiles 200 may be only 0.02 inches to 0.03 inches. It may be possible to have the tile 200 edges actually touch. The integrated projectile barrier 210 provides a blast and ballistic projectile resistant barrier that has excellent performance in all of the desired properties including multi-hit capability, low weight per area, reduced thickness per area, resistance to breakage or cracking, and low manufacturing cost.

Turning now to FIG. 3, it illustrates a perspective view of an application of the integrated projectile barrier 5 of FIG. 1 in an air core reactor 300 with duct sticks 305 in accordance with an exemplary embodiment of the present invention. The air core reactor 300 is for use in an electric power transmission and distribution system or in an electric power system of an electrical plant. A detail of a section of FIG. 3 as marked as "A" is shown in "Detail A". The air core reactor 300 details are shown not to scale.

As used herein, "an air core reactor" refers to an air core reactor for use in an electric power transmission and distribution system or in an electric power system of an electrical plant. The "air core reactor," in addition to the exemplary hardware description above, refers to a system that is configured to provide substation equipment electrical functionality. The air core reactor can include multiple interacting devices, whether located together or apart, that together perform processes as described herein.

The air core reactor 300 comprises an electrically insulated support structure 315, an outer surface 320 of a coil 325 of windings configured to operate at a potential and isolated to ground or other potentials by the electrically insulated support structure 315. The air core reactor 300 further comprises a projectile resistant cylinder 330 that attaches directly to the outer surface 320 of the coil 325 of windings (i.e., considering that the duct sticks are part of the coil). The projectile resistant cylinder 330 is configured as an integrated projectile barrier 310 to provide a first measure of survivability to the air core reactor 300 such that the integrated projectile barrier 310 enables a continued operation of equipment after a threat has been eliminated.

The integrated projectile barrier 310 includes an outer binding layer 335, a middle fragmentation layer 340 adjoining the outer binding layer 335 and an inner absorption layer 345. The inner absorption layer 345 is configured to sandwich the middle fragmentation layer 340 between the outer binding layer 335 and the inner absorption layer 345. In DC applications, the outer binding layer 335 may incorporate electrostatic films.

The integrated projectile barrier 310 is sacrificial in nature so as to improve survivability of the air core reactor 300 during an incident and not to remain operating indefinitely with any damage incurred during hostility. The integrated projectile barrier 310 in conjunction with either a composite rod or a hollow composite station post insulating component to give a second measure of survivability to the air core reactor 300.

To provide a reliable operation the integrated projectile barrier 310 addresses threats and vulnerabilities to the physical security of critical facilities such as electrical power systems. In particular, the integrated projectile barrier 310 reduces the vulnerability of substations to terrorist attacks. Physical attacks on the air core reactor 300 could adversely impact the reliable operation of a Bulk-Power System, resulting in instability, uncontrolled separation, or cascading failures. The integrated projectile barrier 310 reasonably protects against physical security attacks on the air core reactor 300. The integrated projectile barrier 310 enhances physical security measures for the most critical air core reactor 300 facilities and thereby lessens the overall vulnerability of the air core reactor 300 against physical attacks.

Figure 4:
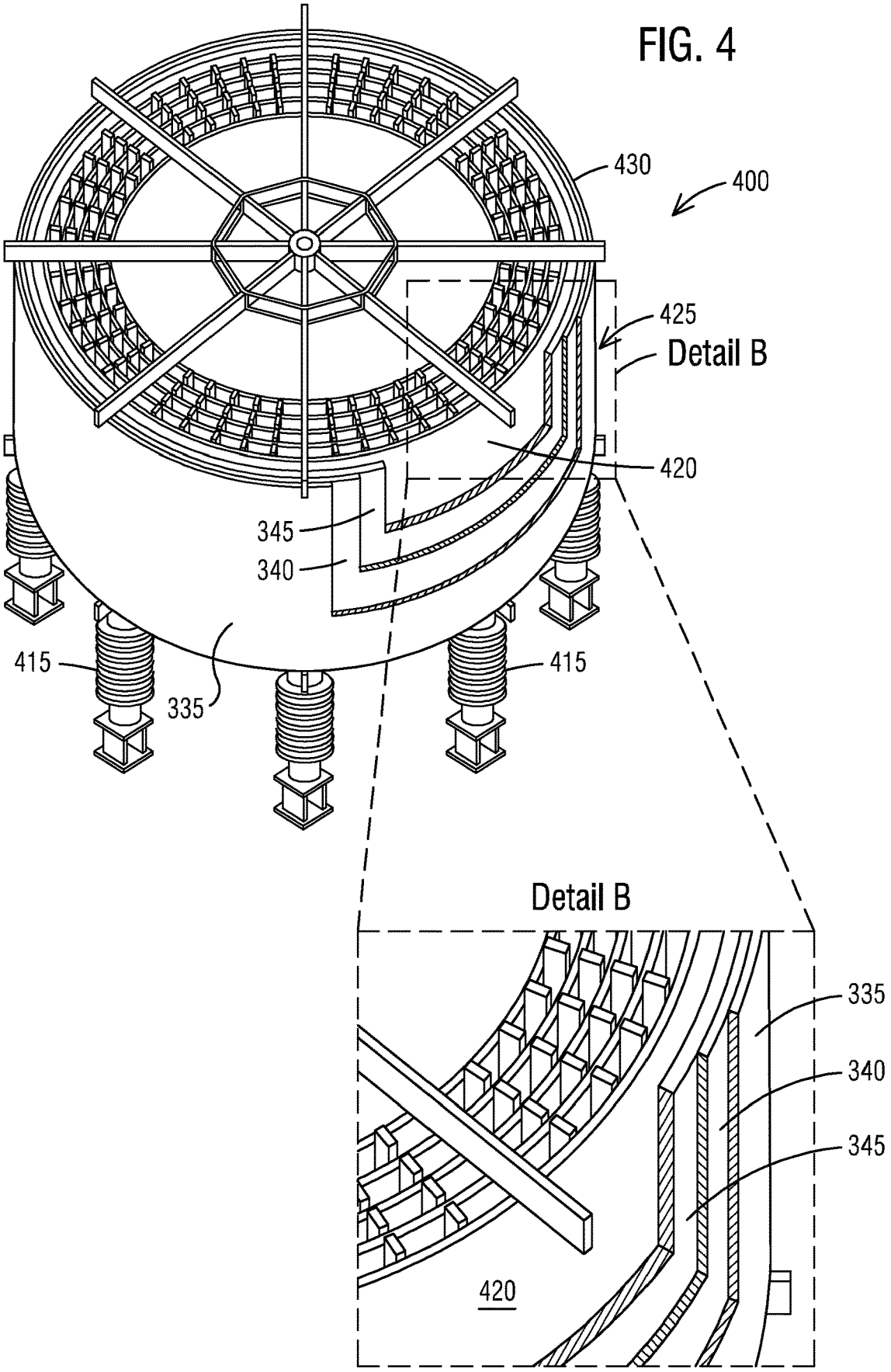
FIG. 4 illustrates a perspective view of an application of the integrated projectile barrier of FIG. 1 in an air core reactor with no duct sticks in accordance with an exemplary embodiment of the present invention.

FIG. 4 illustrates a perspective view of an application of the integrated projectile barrier 5 FIG. 1 in an air core reactor 400 with no duct sticks in accordance with an exemplary embodiment of the present invention. The air core reactor 400 is for use in an electric power transmission and distribution system or in an electric power system of an electrical plant. A detail of a section of FIG. 4 as marked as "B" is shown in "Detail B".

The air core reactor 400 comprises an electrically insulated support structure 415, an outer surface 420 of a coil 425 of windings configured to operate at a potential and isolated to ground or other potentials by the electrically insulated support structure 415. The air core reactor 400 further comprises a projectile resistant cylinder 430 that attaches directly to the outer surface 420 of the coil 425 of windings. The projectile resistant cylinder 430 is configured as an integrated projectile barrier 410 to provide a first measure of survivability to the air core reactor 400 such that the integrated projectile barrier 410 enables a continued operation of equipment after a threat has been eliminated.

The integrated projectile barrier 410 is sacrificial in nature so as to improve survivability of the air core reactor 400 during an incident and not to remain operating indefinitely with any damage incurred during hostility. The integrated projectile barrier 410 in conjunction with either a composite rod or a hollow composite station post insulating component to give a second measure of survivability to the air core reactor 400.

As seen in FIG. 5, it illustrates a flow chart of a method 500 of shielding the air core reactor 300 or 400 according to an exemplary embodiment of the present invention. Reference is made to the elements and features described in FIGS. 1-3. It should be appreciated that some steps are not required to be performed in any particular order, and that some steps are optional.

The method 500 includes, in step 505, providing the projectile resistant cylinder 230 that attaches directly to the outer surface 320 of the coil 325 of windings. The projectile resistant cylinder 330 is configured the integrated projectile barrier 310 to provide a first measure of survivability to the air core reactor 300, 400 such that the integrated projectile barrier 310 enables a continued operation of equipment after a threat has been eliminated. The integrated projectile barrier 310 includes an outer binding layer, a middle fragmentation layer next to the outer binding layer, and an inner absorption layer to sandwich the middle fragmentation layer between the outer binding layer and the inner absorption layer.

The method 500 further includes, in step 510, shielding the air core reactor 300 or 400 from physical attacks such as a projectile by providing a physical security measure. The integrated projectile barrier 310 may provide a physical type of protection measure or shielding from a physical attack on the air core reactor 300, 400, e.g., in a form of a ballistic projectile or a blast. Although the prime objective is as protection for terrorist attacks, embodiments of the present invention could be used in less hostile regions as protection from equipment explosions.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. An air core reactor for use in an electric power transmission and distribution system or in an electric power system of an electrical plant, the air core reactor comprising:

an electrically insulated support structure;

an outer surface of a coil of windings configured to operate at a potential and isolated to ground or other potentials by the electrically insulated support structure; and a projectile resistant cylinder that attaches directly to the outer surface of the coil of windings, the projectile resistant cylinder is configured as an integrated barrier to provide a first measure of survivability to the air core reactor such that the integrated barrier enables a continued operation of equipment after a threat has been eliminated, wherein the integrated barrier includes:

an outer binding layer, a middle fragmentation layer next to the outer binding layer, wherein the middle fragmentation layer is configured to disperse energy of a projectile via fragmenting the projectile, and wherein the middle fragmentation layer comprises a plurality of hardened tiles arranged side-by-side in a two-dimensional array such that the plurality of hardened tiles are ceramic tiles encapsulated in a resin layer, and an inner absorption layer to sandwich the middle fragmentation layer between the outer binding layer and the inner absorption layer, wherein the inner absorption layer is configured to decelerate fragments of the projectile and absorb any remaining energy.

2. The air core reactor of claim 1, wherein the integrated barrier is sacrificial in nature so as to improve survivability of the air core reactor during an incident and not to remain operating indefinitely with any damage incurred during hostility.

3. The air core reactor of claim 1, wherein the integrated barrier in conjunction with either a composite rod or a hollow composite station post insulating component to give a second measure of survivability to the air core reactor.

4. The air core reactor of claim 1, wherein the outer binding layer is configured to make the air core reactor appear nondescript from a typical air core reactor.

5. The air core reactor of claim 4, wherein the outer binding layer comprises fiberglass roving and epoxy resin.

6. The air core reactor of claim 1, wherein the inner absorption layer comprises a combination of fiberglass roving, reinforced cloths and epoxy resin.

7. A method of shielding an air core reactor, the method comprising:

providing a projectile resistant cylinder that attaches directly to an outer surface of a coil of windings, the projectile resistant cylinder is configured as an integrated barrier to provide a first measure of survivability to the air core reactor such that the integrated barrier enables a continued operation of equipment after a threat has been eliminated, wherein the integrated barrier includes:

an outer binding layer, a middle fragmentation layer next to the outer binding layer, wherein the middle fragmentation layer is configured to disperse energy of a projectile via fragmenting the projectile, and wherein the middle fragmentation layer comprises a plurality of hardened tiles arranged side-by-side in a two-dimensional array such that the plurality of hardened tiles are ceramic tiles encapsulated in a resin layer, and an inner absorption layer to sandwich the middle fragmentation layer between the outer binding layer and the inner absorption layer, wherein the inner absorption layer is configured to decelerate fragments of the projectile and absorb any remaining energy.

8. The method of claim 7, wherein the outer binding layer is configured to make the air core reactor appear nondescript from a typical air core reactor.

* * * * *